United States Patent [19]

Ruggero et al.

[11] 4,238,867

[45] Dec. 16, 1980

[54] TUBE ABRADING TOOL

[76] Inventors: Salvatore Ruggero; Joseph Ruggero, both of 84-05 101st Ave., Ozone Park, N.Y. 11416

[21] Appl. No.: 61,189

[22] Filed: Jul. 27, 1979

[51] Int. Cl.[3] ..... A46B 13/02

[52] U.S. Cl. ..... 15/88; 15/23; 15/104.04; 15/104.1 R

[58] Field of Search ..... 15/4, 21 D, 23, 24, 15/88, 104.03, 104.04, 104.1 R; 51/170 R, 170 PT, 170 T, 181 R, 181 NT

[56] References Cited

U.S. PATENT DOCUMENTS

| | | | |
|---|---|---|---|
| 1,717,554 | 6/1929 | Fraser | 51/181 NT |
| 2,383,464 | 8/1945 | Bown | 15/104.03 X |
| 2,635,393 | 4/1953 | Barth | 15/88 X |
| 3,436,783 | 4/1969 | McCartney | 15/104.04 X |
| 3,604,040 | 9/1971 | Cohen | 15/104.1 R |
| 3,774,255 | 11/1973 | Pao | 15/4 |

FOREIGN PATENT DOCUMENTS

| | | | |
|---|---|---|---|
| 1031561 | 6/1966 | United Kingdom | 15/104.04 |

*Primary Examiner*—Edward L. Roberts
*Attorney, Agent, or Firm*—Amster, Rothstein & Engelberg

[57] ABSTRACT

A tube abrading tool for cleaning outer and inner surfaces of ends of pieces of copper tubing such as that employed in domestic water supply systems. The tool includes an electric motor supported in a housing. A longitudinal shaft is rotatably mounted to the motor with the opposite ends of the shaft extending beyond the periphery of the motor housing. A male abrasive member, such as a wire brush, is releasably secured to one end of the shaft and a female abrasive member, such as a wire brush, is releasably secured to the opposite end of the shaft, so that the tool is readily manipulated to clean the inside and the outside of the end of a piece of copper tubing preparatory to soldering.

3 Claims, 4 Drawing Figures

TUBE ABRADING TOOL

Figure 1:
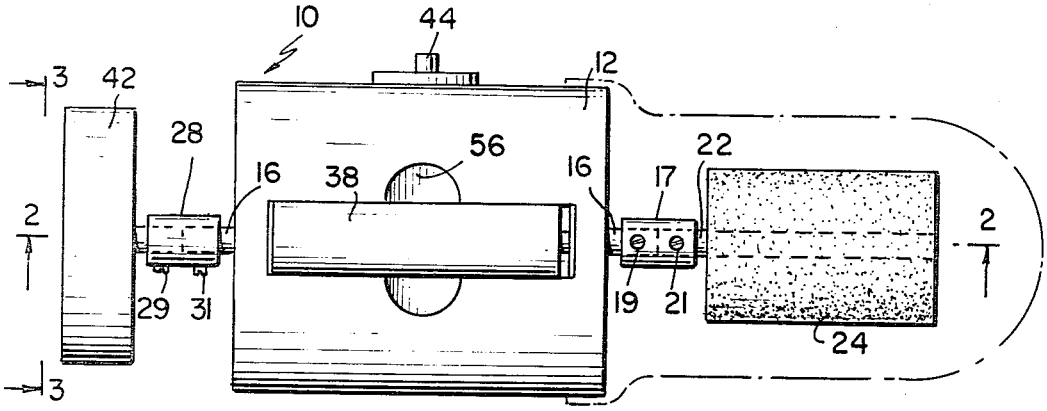

In the use of copper tubing for domestic water supply systems, various sections of tubing are cut and soldered one to the other through overlapping joints, in a manner well known in the art. Prior to soldering, the ends of the tubing that are soldered must be cleaned so that the surfaces of the ends of the tubing are free of oxides of copper and other compounds to facilitate adherence of the soldering compound to the inner and outer surfaces of the pipes to be joined.

In the prior art, brushes for cleaning various types of tubing are known. However, the prior art does not address itself to the necessity of having a single tool which may be employed to clean both the inner and outer surfaces of copper tubing prior to the soldering of such tubing.

Examples of power driven cleaning brushes are disclosed in the prior art U.S. patents of Hanson, U.S. Pat. No. 3,383,727; Swanson U.S. Pat. No. 3,290,711; Page U.S. Pat. No. 1,838,958; Vaughn U.S. Pat. No. 1,710,127, and Hobbs U.S. Pat. No. 3,188,674.

It is desirable to have a tool that may be used for cleaning the outside and inside of a section of tubing to which a second section will be soldered. The aforementioned prior art references disclose tools that are power driven, usually by attachment to a hand held electric drill; however, the brushes employed as the cleaning implement must be changed, depending on whether the outside surface or the inside surface is involved.

It is therefore an object of the present invention to overcome these and other difficulties encountered in the prior art.

It is a further object of the present invention to provide a tool for abraiding the terminal ends of tubing in which a single tool may be employed for cleaning both the inside and the outside of a piece of tubing or a joint member for such tubing.

It is also an object of the present invention to provide such a tool which is readily held by hand and is driven by means of an electric motor, such as a battery powered motor.

In accordance with present invention, a tool for abraiding terminal ends of tubing, such as copper tubing used in a domestic water supply system, comprises a hand held electric motor mounted in a housing. A rotatable longitudinal shaft driven by the motor is provided, both ends of the shaft extending beyond the housing of the motor. One end of the shaft drivingly engages a female abrasive member adapted for rotatably enveloping and abrasively engaging an outer surface of an end of a length of tubing. The opposite end of the shaft has a male abrasive member thereon adapted for rotatable insertion into and abrasive engagement with an inner surface of the end of the length of tubing.

The abrasive member may comprise a wire brush, such as a steel wire brush, the abrasive members being removably secured to the shaft so that abrasive members can be readily changed for operation on variously sized pipes.

Figure 2:
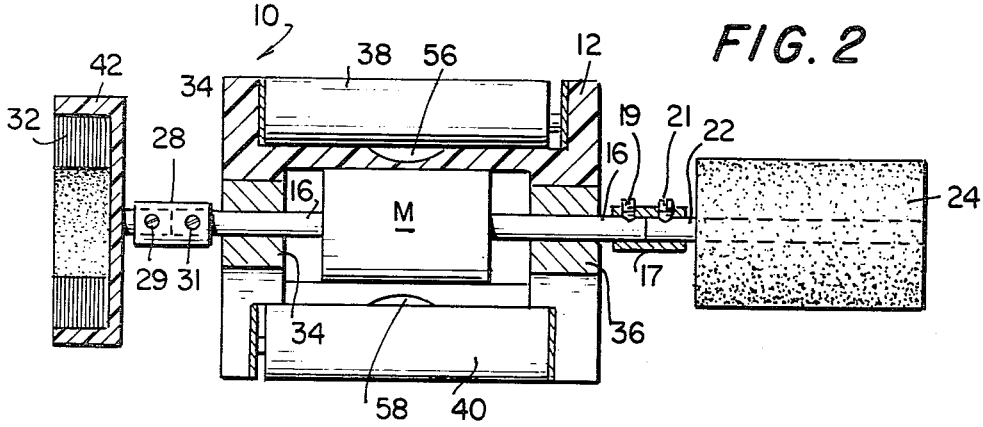
Figure 3:
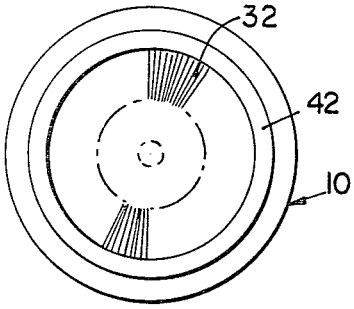

These and other objects have been achieved according to the present invention and will become apparent by reference to the disclosure and claims that follow, as well as the appended drawings in which:

FIG. 1 is a side elevational view illustrative of the hand held tool for abraiding terminal ends of a piece of tubing, the tool having a male brush and a female brush operably driven by an electric motor according to one embodiment of the present invention;

FIG. 2 comprises a sectional view taken along the line 2—2 of FIG. 1;

FIG. 3 comprises an end view taken along line 3—3 of FIG. 1; and

Figure 4:
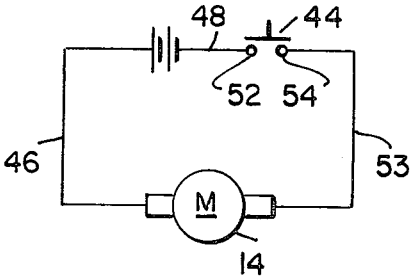

FIG. 4 is a schematic diagram illustrating the electric wiring and switch operation of the electric motor employed in the apparatus illustrated in FIG. 1.

Referring to the drawings and FIGS. 1–4 therein, the tool comprises an electric motor 14 mounted in a housing 12, the dimensions of the housing 12 and the motor 14 being such that the housing is readily held in a hand of an operator. An armature shaft 16 of the motor 14, which may be a single shaft or separate shafts extending from opposite ends of the motor, extends beyond either end of the housing and is longitudinally mounted through opposed anti-friction bearings 34 and 36, such as Oilite ( TM )bearings, known in the art. One end of the shaft 16 is retained in coupling sleeve 17 by retaining screw 19. Shaft 22 on which a male wire brush 24, such as a steel wire bristle brush, is mounted, is retained in coupling sleeve 17 by retaining screw 21. This retaining system provides a quick connect and disconnect mechanism, whereby the shaft 22 can be coupled to the shaft 16. Similarly, the opposite end of the shaft 16 is retained in retaining sleeve 28 by retaining screw 29. Shaft 30 on which a female brush housing 42 is mounted is retained in retaining sleeve 28 by retaining screw 31. Brush bristles, such as wire bristles or steel wire bristles 32, extend around the inner periphery of the housing 42. The housing includes indentations 56, 58 to faciliate gripping the tool.

Preferably, tool 10 is provided with a plurality of male and female brushes 24, 42 of different sizes to accommodate different sizes of tubing. In each instance, however, the shafts 22, 30 are of the same size and readily coupled to the shaft 16 through coupling sleeves 17 or 28 respectively. Thus, the brushes may be quickly changed as cleaning requirements change.

Batteries 38 and 40 are positioned on the motor housing 12, the batteries being electrically connected to the motor 14, as is illustrated in FIG. 4. The batteries 38 and 40 may comprise nickel cadmium or mercury type of dry cells, well known in the art, or the equivalents thereof, which provide longer life and may be rechargeable. The battery means 38, 40 may alternatively comprise a built-in permanent and rechargeable battery. As another alternative, the tool may be provided with an electric cord for attachment to an electric circuit for purposes of driving the motor, as well as recharging the battery means.

The batteries 38 and 40 are connected to the motor 14 by means of electrical conductors 46, 48 and 54, and a push button switch 44 which connects points 52 and 53 (FIG. 4) when depressed, thereby forming circuit and causing the motor 14 to turn.

In use, the brushes are used to prepare copper tubing and copper tubing joints for soldering. By inserting the brush member 24 into a copper joint and engaging the switch 44, the motor 14 is caused to turn, thereby abrading the inner surface of the joint so as to prepare the joint for soldering. The piece of copper tubing to be inserted into the joint thus cleaned is cleaned by employing the opposite end of the apparatus 14, i.e., the brush 42 is used to abrasively clean and remove the oxides of copper from the end of the tubing that is to be soldered into the joint thus prepared.

The apparatus of the present invention may also be used for abraiding the surface of other tubing prior to connecting, such as is the case in joining plastic tubing with a solvent type cement, as is well known in the art.

Although the invention has been described by reference to some embodiments, it is not intended that the novel apparatus for abraiding the terminal ends of tubing be limited thereby, but that modifications thereof are intended to be included as falling within the broad spirit and scope of the foregoing disclosure, the following claims and the appended drawings.

What is claimed is:

1. A tool for abrading the terminal ends of tubing comprising an I-shaped housing having a cylindrical central portion of fixed diameter and flange portions on opposite ends of said cylindrical portion each having the same diameter, which diameter is greater than the fixed diameter of the central cylindrical portion, the central cylindrical portion of said housing having a pair of indentations formed therein on diametrically opposed sides which indentations serve as a holding means for said tool during use, electrical contacts mounted on opposed inner surfaces of said flange members, said flange members adapted to support a longitudinally oriented electrical battery between the inner opposed surfaces thereof in electrical contact with the electrical contacts thereon, an electric motor mounted in the cylindrical central portion of said housing having electrical connection to the electrical contacts on the housing flanges whereby electrical power can be conveyed to operate the motor, said electric motor having two shafts mounted for rotation by said motor extending longitudinally from opposite ends of said housing, a male abrasive member including a wire brush secured to one of said shafts and a female abrasive member including a wire brush secured to the other end of said shafts, said female abrasive member adapted for enveloping and rotatably and abrasively engaging the outer surface of an end of the length of tubing, said male abrasive member adapted for insertion into and rotatably and abrasively engaging the inner surface of the end of a length of tubing so that both the inner and outer surfaces of the end of the length of tubing may be abraided to permit subsequent joining of the tubing to a like abraided tubing to form a continuous length of tubing.

2. The tool of claim 1 wherein at least one of said abrasive members is cooperatively secured to said shaft by a quick release means.

3. The tool of claim 1 wherein said quick release means includes a retaining sleeve which receives the shaft extending from said abrasive member.

* * * * *